United States Patent [19]

Hori et al.

[11] Patent Number: 4,558,993

[45] Date of Patent: Dec. 17, 1985

[54] ROTARY COMPRESSOR WITH CAPACITY MODULATION

[75] Inventors: Michimasa Hori; Hideo Hirano; Yoshinori Kojima, all of Kusatsu; Jiro Yuda, Ikoma, all of Japan

[73] Assignee: Matsushita Electric Industrial Co., Ltd., Osaka, Japan

[21] Appl. No.: 637,534

[22] Filed: Aug. 3, 1984

[30] Foreign Application Priority Data

Aug. 3, 1983 [JP] Japan ..... 58-143023
Aug. 3, 1983 [JP] Japan ..... 58-143024
Aug. 3, 1983 [JP] Japan ..... 58-143025
Aug. 3, 1983 [JP] Japan ..... 58-143027

[51] Int. Cl.[4] ..... F04B 49/08

[52] U.S. Cl. ..... 417/283; 417/299; 417/310

[58] Field of Search ..... 417/283, 299, 310

[56] References Cited

U.S. PATENT DOCUMENTS 2,193,244 3/1940 Wolcott ..... 417/299
3,767,328 10/1973 Ladusaw ..... 417/310 X
4,344,297 8/1982 Ueno ..... 417/299 X
4,373,352 2/1983 Ladusaw ..... 417/283 X
4,459,817 7/1984 Inagaki et al. ..... 417/299 X

FOREIGN PATENT DOCUMENTS 2807301 8/1979 Fed. Rep. of Germany ..... 417/283

*Primary Examiner*—Richard E. Gluck
*Attorney, Agent, or Firm*—Wenderoth, Lind & Ponack

[57] ABSTRACT

The compression capacity of a rotary compressor may be changed by a cylinder bypass system. The change of compression capacity is achieved by a slide wall member which composes part of an inside wall of a cylinder containing a compression mechanism and which is movable, thereby bypassing gas being compressed to a suction side of the compressor. The slide wall member is caused to slide forward by gas pressure applied and to slide backward by a spring force. By controlling such gas pressure, the capacity of the compressor may be changed. A relatively large opening is formed in the cylinder when the slide wall member is moved backward, so that the compression capacity can be greatly reduced without a large decrease in efficiency.

10 Claims, 6 Drawing Figures

ROTARY COMPRESSOR WITH CAPACITY MODULATION

BACKGROUND OF THE INVENTION

In many uses of refrigerant compressors, it is desirable to be able to reduce the capacity or volume of displacement of the compressor under certain operating conditions in order to provide a cooling or heating rate more closely matching a heat load. A means intended to provide modulation or partial unloading of a rotary compressor is described in U.S. Pat. No. 3,767,328 as comprising a radially extending bore formed in a cylindrical wall member of the compressor and communicating with the cylinder and a passage in the wall member having a modulating port in a wall portion of the bore connecting a suction port to the bore and a plunger slidably mounted in the bore. The compressor is intended to operate at full capacity by introducing high pressure refrigerant into the bore behind the plunger to hold the plunger closed. When a reduced pressure is substituted, the plunger opens and gas compression in the cylinder is delayed until the bore is sealed by the rotor.

A plunger of this type has certain disadvantages. For full displacement operating conditions, the plunger is positioned in its fully extended position where it is in constant contact with the rotor completely filling the cylinder end of the bore. This increases the mechanical load of the compressor and causes a decrease in efficiency. For partial load operation, substantial reduction in compression capacity cannot be achieved, since the diameter of the bore cannot be made sufficiently large.

SUMMARY OF THE INVENTION

It is a general object of the present invention to provide a rotary compressor of the stationary vane type with improved valving means for controlling both full and partial capacity operation of the compressor.

In accordance with the preferred embodiment of the invention, there is provided a hermetic rotary refrigerant compressor comprising a hermetic casing containing a rotary compressor including a cylinder block having a cylindrical wall defining a compression cylinder, upper and lower bearing members mounted to close the upper and lower end surfaces of this cylinder, a rotary compression mechanism, for example, a rotor eccentrically rotatable in the cylinder, spaced suction and discharge ports in a wall and communicating with the cylinder and a vane slidably mounted for engagement with the rotor to divide the cylinder into high and low pressure sides or chambers.

In order to modulate the capacity of the compressor, there are provided a slide wall member which forms part of an end inner wall of the cylinder, an opening extending through a flange portion of one of the upper or lower bearing members for housing the slide wall member, a control port communicated with the opening for controlling a back pressure applied to the slide wall member and a spring for moving the slide wall member against the back pressure. A recess in the slide wall member obviates the need for separately providing a space for housing the spring, thus saving space. Space also is saved by using an elliptical spring. By making flat both a front surface of the slide wall member and a surface of the opening against which abuts the front surface, a reduction in performance during full capacity operation may be averted. The sliding direction of the slide wall member is in the radial direction of the cylinder, so that sealing at the front surface of the slide wall member is improved and a reduction in performance at full capacity operation does not occur. As the opening is provided in the flange portion of the lower bearing member, a relatively large amount of lubricant is positioned adjacent the slide wall member, whereby noise reduction, prolongation of operating life and improved efficiency are achieved. By the opening extending through the flange portion of the upper or lower bearing member, it is possible to form the structure at high accuracy in the thickness direction of the slide wall member and, therefore, to form a tight seal in the thickness direction, and no reduction in efficiency at full capacity operation occurs.

DETAILED DESCRIPTION OF THE PREFERRED EMBODIMENT

Figure 1:
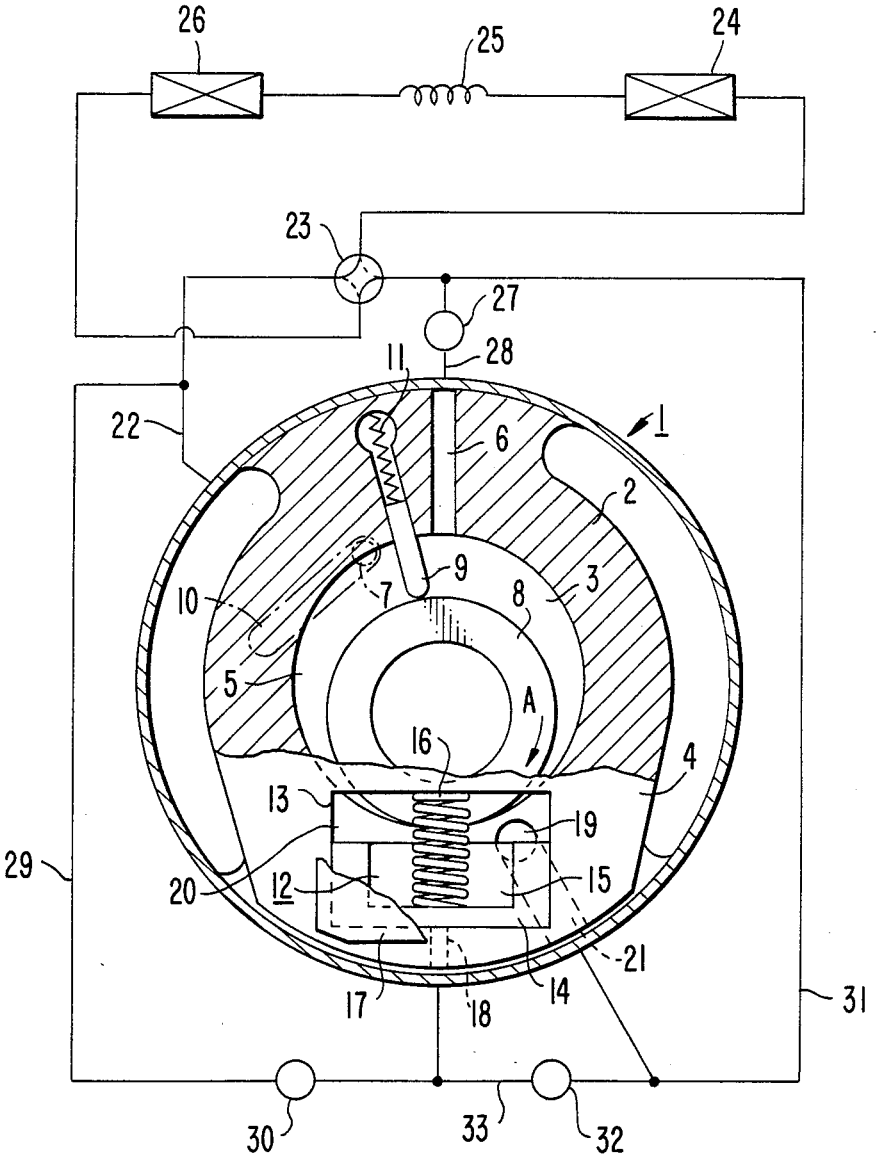
FIG. 1 is a schematic view, partly in section, of a refrigeration system disclosing one means for controlling the operation of an unloading slide wall member in a compressor of the present invention.

Referring to FIG. 1, 1 denotes a closed container or housing of a rotary compressor, inside of which there is a cylinder 5 defined by a cylindrical member 2, an upper bearing member 3 and a lower bearing member 4. Numerals 6 and 7 designate respectively suction and discharge ports respectively opening into cylinder 5. Numeral 8 designates a rolling piston forming a rotary compression mechanism. A partition vane 9 partitions high and low pressure compartments in the cylinder. 10 is a discharge valve, 11 is a spring for the partition vane 9, and 12 is a compression capacity control mechanism which includes an opening 13 extending into the cylinder 5 through a portion of lower bearing member 4. A slide wall member 14 housed in opening 13 defines part of the cylinder 5 and slides in opening 13 in a direction substantially radially of the axis of bearing member 4. A recess 15 provided on the lower side of slide wall member 14 receives an elliptical spring 16. A cover plate 17 closes the lower end of the opening 13. A control port 18 extends through member 4 to opening 13 for controlling the back pressure of slide wall member 14 in opposition to the force of the spring 16.

Numeral 19 denotes a bypass port provided in the interior of the cylindrical member 2 and in communication with a front space 20 of the opening 13, at a position when the cylinder 5 and this front space 20 communicate with each other, i.e. as shown in FIG. 1 when slide wall member 14 is pushed by the spring 16. Port 19 is connected to a bypass passage 21. To the rotary compressor are connected a discharge pipe 22, a four-way valve 23, a load side heat exchanger 24, a pressure reducer 25, a heat source side heat exchanger 26, an accumulator 27 and a suction pipe 28 which is connected to the suction port 6. A back pressure pipe 29 is branched from midway between the discharge pipe 22 and the four-way valve 23 and is joined to the control port 18 through a first solenoid valve 30. A bypass pipe 31 connects the bypass passage 21 with the upstream side of the accumulator 27. An intermediate position between the control port 18 and the first solenoid valve 30 is joined by a high pressure escape pipe 33 to the bypass pipe 31 through a second solenoid valve 32.

Figure 2:
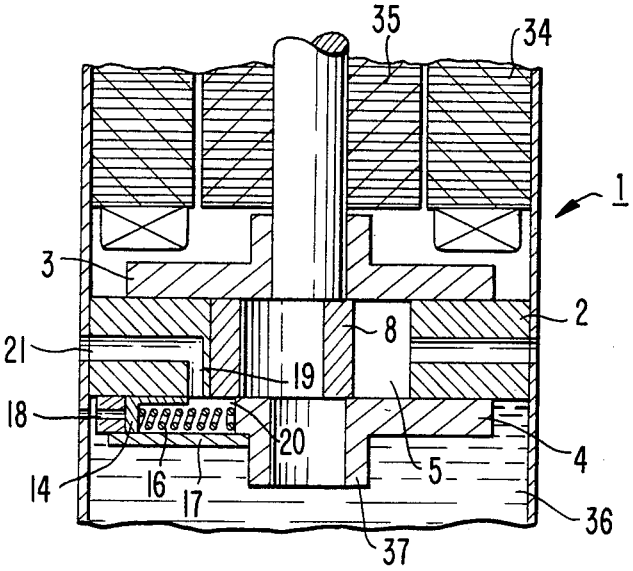
FIG. 2 is a cross sectional elevation view of the compressor of FIG. 1.
Figure 3:
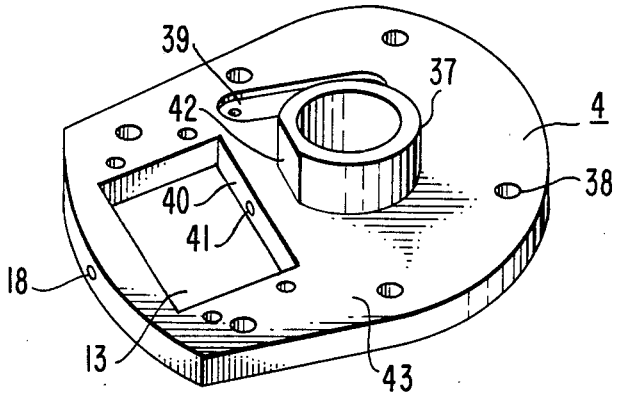
FIG. 3 is a perspective view of a lower bearing member shown in FIG. 2.
Figure 4:
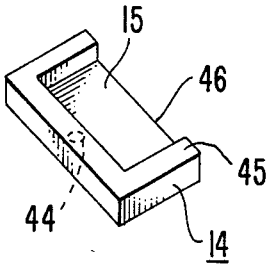
FIG. 4 is a perspective view of a slide wall member shown in FIG. 2.
Figure 5:
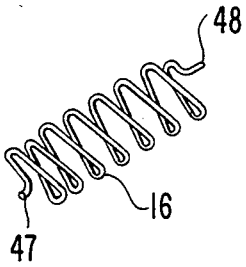
FIG. 5 is a perspective view of an elliptical spring shown in FIG. 2.
Figure 6:
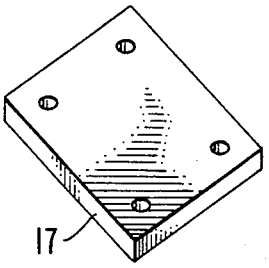
FIG. 6 is a perspective view of a cover plate shown in FIG. 2.

Referring to FIG. 2, a motor including a stator 34 and a rotor 35 provides a driving source. The bottom of the closed container or housing 1 of the rotary compressor is filled with lubricant 36 into which is immersed the lower bearing member 4. Numeral 37 designates a boss of the lower bearing member 4. Referring to FIG. 3, member 4 includes bolt holes 38 for mounting the lower bearing member 4 and a valve seat 39 for the discharge valve 10. At the center of an abutting surface 40 of opening 13 adjacent boss 37 is provided a spring hole 41 for fixing an end of the spring 16. Boss 37 has a side surface or notch 42 positioning cover plate 17. Opening 13 extends through a flange portion 43 of the lower bearing member 4. Referring to FIG. 4, hole 44 for receiving an end of spring 16 is formed on a wall of recess 15 of the slide wall member 14 which has a slide surface 45 to be in contact with the inner upper surface of the cover plate 17. A front surface 46 of member 14 abuts the surface 40 of the opening 13. Referring to FIG. 5, a protrusion 47 at one end of the spring 16 is inserted into the spring hole 44, while a protrusion 48 on the other end of spring 16 is inserted into the spring hole 41.

In the following, the operation of the machine with the aforementioned contruction is described. First, when the rotary compressor is operated at fully capacity for heating, the rolling piston 8 turns in the direction of the arrow A in a state with the first solenoid valve 30 open and the second solenoid valve 32 closed. Accordingly, with high pressure gas led to the control port 18 through the back pressure pipe 29, the slide wall member 14 closes the front space 20, overcoming the force of the spring 16. At this time, the front portion 46 of the slide wall 14 is pressed against abutting surface 40 of the opening 13 by the high pressure applied through port 18 against the opposite side of the slide wall member 14. For this reason, the high pressure gas inside the control port 18 will not leak into the cylinder 5 through the slide surface 45, nor will the compressed gas inside the cylinder 5 lead in large amounts through port 19 and passage 21 into the bypass pipe 31, thereby preventing a drop in efficiency. Accordingly, in this instance, most of the refrigerant gas introduced into the cylinder 5 through the suction port 6 is discharged to the discharge pipe 22 through the discharge port 7 and discharge valve 10, and then is passed through the four-way valve 23, through the load side heat exchanger 24, which is installed inside a room, the pressure reducer 25, the heat source side heat exchanger 26, four-way valve 23, accumulator 27 and a suction pipe 28, thereby again being introduced into cylinder 5 through port 6. At this time, the room is heated at a high capacity by means of the load side heat exchanger 24.

Then, when the room temperature has increased to a specified value, by operation of a temperature regulator, etc. the first solenoid valve 30 is closed and simultaneously the second solenoid valve 32 is opened. Therefore, the high pressure gas inside the control port 18 passes to the bypass pipe 31 through the high pressure escape pipe 33. Accordingly, the slide wall member 14 will be returned to the position shown in FIG. 1 by the spring 16. As a result, front space 20 open to cylinder 5 is formed, and part of the bypass port 19 is opened to front space 20. At this time, part of the gas inside the cylinder 5, while being compressed, flows into front space 20 and is bypassed to the upstream side of the accumulator 27 through bypass port 19, passage 21 and bypass pipe 31. It should be noted that in this instance, even if the opening area of the bypass port 19 is small, or in extreme case in the absence of such bypass port 19, the pressure rise inside the front space 20 is not large, if the volume of the front space 20 and the recess 15 is larger than the volume of the cylinder 5. Therefore, the amount of the gas inside the compression chamber of the cylinder 5 after the rolling piston 8 has passed the opening 13 is greatly reduced, so that the gas discharged through the discharge pipe 22 greatly diminishes. As a result, the heating capacity based on the load side heat exchanger 24 decreases, approaching the heating load.

Cooling is conducted by an operation similar to the aforementioned heating operation, effected merely by switching of the four-way valve 23.

As described in the foregoing, in this embodiment, through switching of the first and second solenoid valves 30 and 32, the slide wall member 14 is moved and the capacity of the rotary compressor is changed greatly, thereby enabling air-conditioning in response to cooling and heating loads. When the first solenoid valve 30 is opened to introduce high pressure gas to the control port 18, the lubricant inside the opening 13 is sealed in the recess 15, thereby forming an oil damper which reduces noise caused by impact of the front surface 46 on the abutting surface 40. As the slide wall member 14 slides in the radial direction toward the cylinder 5, closing the front space 20 to provide full capacity, the front surface 46 of the slide wall 14 and the abutting surface 40 of the opening 13, both being planar, closely abut each other, thereby not only achieving a high degree of sealing, but also providing almost no clearance to the cylinder 5. Consequently, amount no drop in efficiency occurs during full capacity operation due to the compression capacity control mechanism 12. Since the pressure of the gas in the cylinder 5 is exerted in a direction perpendicular to the sliding direction of the slide wall member 14, the slide wall member will not be pushed back, even if the opening 13 is located at a position where the crank angle is large. Accordingly, it is possible to freely design the desired rate of capacity control, and this is especially effective in increasing the control width. The opposite end portions of the abutting surface 40 facing the cylinder 5 are not exposed to the cylinder 5. Accordingly, the small clearance volumes formed at the corners of opposite end portions of the front surface 46 of the slide wall member, not being open to the cylinder 5, have no influence on performance. Also, the abutting surface 40 of the opening 13 and the front surface 46 of the slide wall member 14, both being planar, easily permit the formation of a close sealing fit as they are abutted with each other. The slide wall member 14 thus takes the role of a valve for closing the bottom of bypass port 19. Therefore, a separate bypass port valve need not be provided.

The opening 13 extends through the flange section 43 and is closed by cover plate 17. It is possible to grind both surfaces of the flange section 43 and the inside surface of the cover plate 17. Consequently, the depth of the opening 13 may be uniformly equal to the thickness of he flange portion 43. Accordingly, if the slide wall member 14 has a highly accurate thickness, a close between the slide surface 45 and the inside surface of the cover plate 17 may be achieved.

When the first solenoid valve 30 is closed and the second solenoid valve 32 is opened, such that the slide wall member 14 is pushed back by the force of the spring 16, a large semicircular opening is produced at the cylinder section 5 and a large volume space is formed by the front space 20 and the recess 15. Also, part of the bypass port 19 is opened, as shown in FIG. 1. Accordingly, until after the rolling piston 8 has passed through the aforementioned semicircular opening, the compression of the gas will not be well performed in the high pressure compartment of the cylinder 5. Thus, not only is large capacity control made possible, but also power consumption is greatly curtailed. Since the spring 16 is nearly elliptical in section, the recess 15 may be shallow and, in turn, the thickness of the flange section 43 of the lower bearing member 4 provided with the opening 13 may be small. The buckling strength of the elliptical spring also is superior to a spring with a circular cross-section. Therefore, a long life span and miniaturization of the compression capacity control mechanism can be achieved.

While there has been shown and described a specific embodiment of the invention, it will be understood that the invention is not limited thereto and that the various modifications thereof fall within the true spirit and scope of the invention.

What is claimed is:

1. In a rotary compressor of the type including a cylinder block having therein a cylinder having a vertical axis, upper and lower bearing members having flanges with radially extending surfaces closing upper and lower ends of said cylinder, a suction port opening into said cylinder for introducing therein gas to be compressed, a rotor mechanism rotatable within said cylinder for compressing said gas, a discharge port extending from said cylinder for discharging therefrom the compressed gas, and means for changing the compression capacity of said compressor, the improvement wherein said means comprises:

an opening formed in said flange of one of said bearing members, said opening extending from the respective said radially extending surface into said flange in a depth direction parallel to said axis, and said opening facing a portion of the respective said end of said cylinder and a portion of a respective end surface of said cylinder block;

a slide wall member mounted within said opening for sliding movement in opposite directions at right angles to said axis between a first position, whereat the slide wall member opens communication between said opening and said end portion of said cylinder, and a second position, whereat said slide wall member blocks communication between said opening and said end portion of said cylinder;

spring means mounted within said opening for biasing said slide wall member in a first said direction to said first position;

a control port extending into said opening at a location on a side of said slide wall member opposite said end portion of said cylinder; and valve means for selectively introducing into said control port compressed gas from said discharge port, thereby sliding said slide wall member in said opening in a second said direction opposite the force of said spring means to said second position, thus blocking communication between said cylinder end portion and said opening and providing a relatively larger compression capacity of said cylinder, and for selectively interrupting introduction into said control port of compressed gas from said discharge port, whereby said spring means slides said slide wall member in said opening in said first direction to said first position, thus opening communication between said cylinder end portion and said opening and providing a relatively smaller compression capacity of said cylinder.

2. The improvement claimed in claim 1, wherein said slide wall member has formed therein a concave recess receiving and housing at least a portion of said spring means.

3. The improvement claimed in claim 1, wherein said spring means comprises a coil spring which has a configuration flattened in a dimension parallel to said axis.

4. The improvement claimed in claim 1, wherein said slide wall member has a planar end surface which abuts with a planar surface defining said opening when said slide wall member is in said second position.

5. The improvement claimed in claim 1, wherein said opposite first and second directions extend radially of said axis.

6. The improvement claimed in claim 1, wherein said opening is formed in said flange of said lower bearing member.

7. The improvement claimed in claim 1, wherein said opening extends axially entirely through said flange, and further comprising a cover plate closing the end of said opening opposite said cylinder.

8. The improvement claimed in claim 1, wherein said spring means comprises a coil spring which has a configuration flattened in a dimension parallel to said axis, said slide wall member has formed therein a concave recess receiving and housing at least a portion of said coil spring, said slide wall member has a planar end surface which abuts with a planar surface defining said opening when said slide wall member is in said second position, said opposite first and second directions extend radially of said axis, said opening extends axially entirely through said flange of said lower bearing member, and further comprising a cover plate closing the lower end of said opening.

9. The improvement claimed in claim 1, further comprising a by-pass port extending through said cylinder block and opening onto said end surface portion thereof, and said cylinder end portion communicates with said by-pass port through said opening when said slide wall member is in said first position.

10. The improvement claimed in claim 9, wherein said valve means comprises means for, upon said interruption of the introduction of compressed gas into said control port, connecting said by-pass port to said suction port.

* * * * *